US009287634B2

(12) United States Patent
Kawamura et al.

(10) Patent No.: US 9,287,634 B2
(45) Date of Patent: Mar. 15, 2016

(54) CRIMP TERMINAL, CONNECTION STRUCTURAL BODY AND CONNECTOR

(71) Applicants: FURUKAWA ELECTRIC CO., LTD., Tokyo (JP); FURUKAWA AUTOMOTIVE SYSTEMS, INC., Inukami-gun (JP)

(72) Inventors: Yukihiro Kawamura, Tokyo (JP); Takashi Tonoike, Tokyo (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/445,212

(22) Filed: Jul. 29, 2014

(65) Prior Publication Data

US 2014/0335745 A1 Nov. 13, 2014

Related U.S. Application Data

(63) Continuation of application No. PCT/JP2013/069691, filed on Jul. 19, 2013.

(30) Foreign Application Priority Data

Jul. 20, 2012 (JP) ..... 2012-162076

(51) Int. Cl.

| | |
|---|---|
| ***H01R 4/10*** | (2006.01) |
| ***H01R 4/18*** | (2006.01) |
| ***H01R 4/20*** | (2006.01) |
| ***H01R 13/52*** | (2006.01) |
| *H01R 4/62* | (2006.01) |

(52) U.S. Cl.
CPC .. *H01R 4/18* (2013.01); *H01R 4/10* (2013.01); *H01R 4/206* (2013.01); *H01R 13/52* (2013.01); *H01R 4/62* (2013.01)

(58) Field of Classification Search
USPC ..... 439/878, 741, 430, 442, 203, 585; 174/84 C
See application file for complete search history.

(56) References Cited

U.S. PATENT DOCUMENTS 2,810,897 A * 10/1957 Schinske ..... 174/84 C
3,955,044 A * 5/1976 Hoffman et al. ..... 174/84 C (Continued)

FOREIGN PATENT DOCUMENTS

CN 201937050 U 8/2011
CN 102576949 A 7/2012

(Continued)

OTHER PUBLICATIONS

International Search Report issued Oct. 22, 2013, in International Application No. PCT/JP2013/069691, filed Jul. 19, 2013 (with English language translation).

(Continued)

*Primary Examiner* — Abdullah Riyami
*Assistant Examiner* — Harshad Patel
(74) *Attorney, Agent, or Firm* — Oblon, McClelland, Maier & Neustadt, L.L.P.

(57) ABSTRACT

The present invention has an object of providing a crimp terminal capable of maintaining a high level of water-blocking performance for a long time in a state of being pressure-bonded to an insulated wire, a connection structural body including the same, and a connector including such a connection structural body.

13 Claims, 6 Drawing Sheets

(56) References Cited

U.S. PATENT DOCUMENTS

| | | | | |
|---|---|---|---|---|
| 6,000,976 | A * | 12/1999 | Takagishi et al. | 439/877 |
| 8,974,258 | B2 * | 3/2015 | Mitose et al. | 439/877 |
| 2002/0096352 | A1 | 7/2002 | Kuwayama et al. | |
| 2009/0315419 | A1 * | 12/2009 | Mita et al. | 310/71 |
| 2010/0144189 | A1 | 6/2010 | Watanabe et al. | |
| 2011/0070781 | A1 * | 3/2011 | Kitagawa et al. | 439/877 |
| 2013/0095708 | A1 * | 4/2013 | Mitose et al. | 439/878 |

FOREIGN PATENT DOCUMENTS

| | | | | |
|---|---|---|---|---|
| DE | 298 06 778 | U1 | 9/1999 | |
| JP | 64-9361 | | 1/1989 | |
| JP | 2002-216862 | | 8/2002 | |
| JP | 2010-140651 | | 6/2010 | |
| JP | WO 2011/122622 | * | 10/2011 | |
| JP | WO2011/125559 | * | 10/2011 | 439/866 |
| JP | 2012-003856 | A | 1/2012 | |
| WO | 2011/118624 | A1 | 9/2011 | |

OTHER PUBLICATIONS

Office Action issued Dec. 31, 2014 in Chinese Patent Application No. 201380004751.4 (with English Translation).

Search Report issued Jul. 3, 2014 in Chinese Patent Application No. 2013800047514.

Written Opinion issued Aug. 23, 2014 in Korean Patent Application No. 10-2014-7016950 B (with English Translation).

Search Report issued Aug. 26, 2015 in European Patent Application No. 13 81 9464.2.

Decision to Grant a Patent issued Dec. 19, 2013 in Japanese Patent Application No. 2013-544901 (with English Translation).

Notification to Grant Patent Right for Invention issued in Chinese Patent Application No. 201380004751.4 (with English Translation).

Grant to Patent issued Nov. 17, 2014 in Korean Patent Application No. 10-2014-7016950 (with English Translation).

* cited by examiner

CRIMP TERMINAL, CONNECTION STRUCTURAL BODY AND CONNECTOR

CROSS-REFERENCE TO RELATED APPLICATIONS

This application is a continuation application of PCT International Application No. PCT/JP2013/069691 filed Jul. 19, 2013, which claims priority to Japanese Application No. 2012-162076 filed Jul. 20, 2012, both of which are herein incorporated by reference in their entirety for all purposes.

TECHNICAL FIELD

The present invention relates to a crimp terminal attachable to a connector or the like provided for, for example, connection of a wire harness for an automobile, a connection structural body including the same, and a connector including such a connection structural body.

BACKGROUND ART

A crimp terminal includes a pressure-bonding section that electrically connects a conductor of an insulated wire thereto. More specifically, the insulated wire is inserted into the pressure-bonding section, and then the pressure-bonding section is caulked to be pressure-bonded to the conductor. Thus, the insulated wire is connected to the pressure-bonding section.

Such a crimp terminal is used for, for example, a wire harness that connects electric parts of an automobile to each other.

As automobiles are improved in safety, comfort and convenience, wire harnesses are improved in functionality and performance and thus are increased in diameter and weight. In such a situation, insulated wires, which are considered to occupy about 60% of the total weight of wire harnesses, now include conductors formed of aluminum or an aluminum alloy instead of copper.

By contrast, crimp terminals are formed of copper. Where the conductor is formed of aluminum instead of copper, the pressure-bonding section of the crimp terminal is subjected to dissimilar metal contact. More specifically, when contacting water or moisture, the pressure-bonding section is easily corroded. This is referred to as "galvanic corrosion".

In order to prevent galvanic contact from occurring even in the case where the conductor is formed of aluminum, the technology disclosed in, for example, Patent Document 1 has been developed. According to this technology, the contact interface between the aluminum conductor and the crimp terminal is isolated from outside with a resin material so that water is blocked. According to such a corrosion-resisting structure disclosed in Patent Document 1, the insulated wire is connected to the crimp terminal, and then a mold portion formed of a resin is formed in a connection part where the crimp terminal and the insulated wire are connected to each other.

However, such a corrosion-resisting structure has the following problem. The connection part where the crimp terminal, formed of a metal material, and the insulated wire, which is formed of a resin, are connected to each other is molded with a resin material. Therefore, the resin material used for the mold portion is deteriorated after being used for a long time and the water-blocking performance thereof is declined.

CITATION LIST

Patent Literature

Patent Document 1: Japanese Laid-Open Patent Publication No. 2012-3856

SUMMARY OF INVENTION

Technical Problem

The present invention has an object of providing a crimp terminal capable of maintaining a high level of water-blocking performance for a long time in the state of being pressure-bonded to an insulated wire, a connection structural body including the same, and a connector including such a connection structural body.

Solution to Problem

The present invention is directed to a crimp terminal, including a pressure-bonding section that allows at least a conductor tip of a conductor of an insulated wire to be connected thereto by pressure-bonding, the conductor being covered with an insulating cover, and the conductor tip being exposed as a result of peeling off the insulating cover on a tip side, wherein the pressure-bonding section has an annular cross-section and has an inner space that allows at least the conductor tip to be inserted thereinto; the pressure-bonding section having the annular cross-section includes a sealing portion on a tip side thereof in which portions, facing each other, of an inner surface of the pressure-bonding section are in close contact with each other and which seals the pressure-bonding section; and the sealing portion has a concaved-shaped cross-section.

The width direction is generally perpendicular to a longitudinal direction which is the same as a longitudinal direction of the insulated wire to be connected to the pressure-bonding section by pressure-bonding. The cross-section having an annular shape or the like is a cross-section taken along a plane perpendicular to the longitudinal direction, namely, taken along a plane in the width direction.

The concaved-shaped cross-section may be generally U-shaped, generally elliptical, generally semi-circular, generally V-shaped or W-shaped with angled corners when seen in the front side.

According to the present invention, the water-blocking performance can be maintained for a long time in the state where the insulated wire is pressure-bonded.

This will be described in more detail. The pressure-bonding section has an annular cross-section and has an inner space that allows at least the conductor tip to be inserted thereinto. The pressure-bonding section having the annular cross-section includes a sealing portion on a tip side thereof in which portions, facing each other, of an inner surface of the pressure-bonding section are in close contact with each other and which seals the pressure-bonding section. Owing to this, the pressure-bonding section having an annular cross-section provides water-blocking performance with certainty.

However, in the case where the sealing portion is formed by deforming a portion on the tip side of the pressure-bonding section such that the portion is flat in the width direction to such a degree that the portions, facing each other, of an inner surface of the pressure-bonding section are in close contact with each other, the cross-sectional coefficient of the sealing portion is smaller than that of the rest of the crimp terminal. In this case, the strength of the sealing portion formed to provide the water-blocking performance is lowered, and the sealing portion may be bent in the middle. According to the present invention, the sealing portion is formed to have a concaved-shaped cross-section that is wide in the width direction. Owing to this, the cross-sectional coefficient of the sealing portion is increased and thus the crimp terminal has a sufficient strength with certainty.

As a result, the pressure-bonding section can prevent water from entering from the tip side thereof, and also is strong and thus is not bent in the middle. Therefore, the water-blocking performance can be maintained for a long time in the state where the insulated wire is pressure-bonded.

In an embodiment of the present invention, the sealing portion may be welded in a width direction such that the portions of the inner surface are fixed to each other.

According to the present invention, the water-blocking performance of the sealing portion can be improved.

There is no limitation on the method for welding the sealing portion such that the portions of the inner surface are fixed to each other. In the case where the welding is performed by use of laser, particularly, fiber laser, stability and high reliability are provided.

In an embodiment of the present invention, the conductor may be formed of an aluminum-based material, and at least the pressure-bonding section may be formed of a copper-based material.

According to the present invention, the insulated wire can be more lightweight than an insulated wire including a conductor formed of copper, and so-called galvanic corrosion can be prevented.

This will be described in more detail. In the case where the conductor of the insulated wire is formed of an aluminum-based material such as aluminum, an aluminum alloy or the like instead of a copper-based material conventionally used, and the conductor formed of such an aluminum-based material is pressure-bonded to the crimp terminal, the following problem Occurs. The phenomenon that the aluminum-based material, which is a less noble metal material is corroded by contact with the terminal plated with a nobler metal material such as tin, gold or the like or formed of a copper alloy or the like occurs; namely, galvanic corrosion occurs.

Galvanic corrosion is a phenomenon that when moisture is attached to a contact part where a nobler metal material and a less noble metal material contact each other, a corrosion electric current is generated and the less noble metal material is corroded, melt, eliminated or the like. When this phenomenon occurs, the conductor formed of an aluminum-based material and pressure-bonded to the pressure-bonding section of the crimp terminal is corroded, melt or eliminated, which leads to increase in electric resistance. This causes a problem that a sufficient conducting function is not provided.

When the pressure-bonding is performed with the desirable shape as described above, the insulated wire is made more lightweight than an insulated wire including a conductor formed of a copper-based material, while being protected against so-called galvanic corrosion.

As a result, a connection state having stable conductivity with certainty is provided regardless of the types of metal used to form the crimp terminal and the conductor of the insulated wire.

The pressure-bonding section may be formed of, for example, a copper-based material such as copper, a copper alloy or the like. The conductor may be formed of, for example, aluminum raw wires, aluminum alloy raw wires or the like.

The present invention is also directed to a connection structural body, including the insulated wire and the above-described crimp terminal, which are connected to each other by the pressure-bonding section of the crimp terminal.

According to the present invention, a connection state having stable conductivity with certainty is provided.

The present invention is also directed to a wire harness, including a plurality of the above-described connection structural bodies bound together.

According to the present invention, the wire harness has stable conductivity with certainty regardless of the types of metal used to form the crimp terminal and the conductor.

The present invention is also directed to a connector, including the crimp terminal in the above-described connection structural body, the crimp terminal being located in a connector housing.

According to the present invention, a connection state having stable conductivity with certainty is provided.

Advantageous Effects of Invention

The present invention provides a crimp terminal capable of maintaining a high level of water-blocking performance for a long time in the state of being pressure-bonded to an insulated wire, a connection structural body including the same, and a connector including such a connection structural body.

DESCRIPTION OF EMBODIMENTS

Hereinafter, an embodiment of the present invention will be described with reference to the drawings.

Figure 1A:
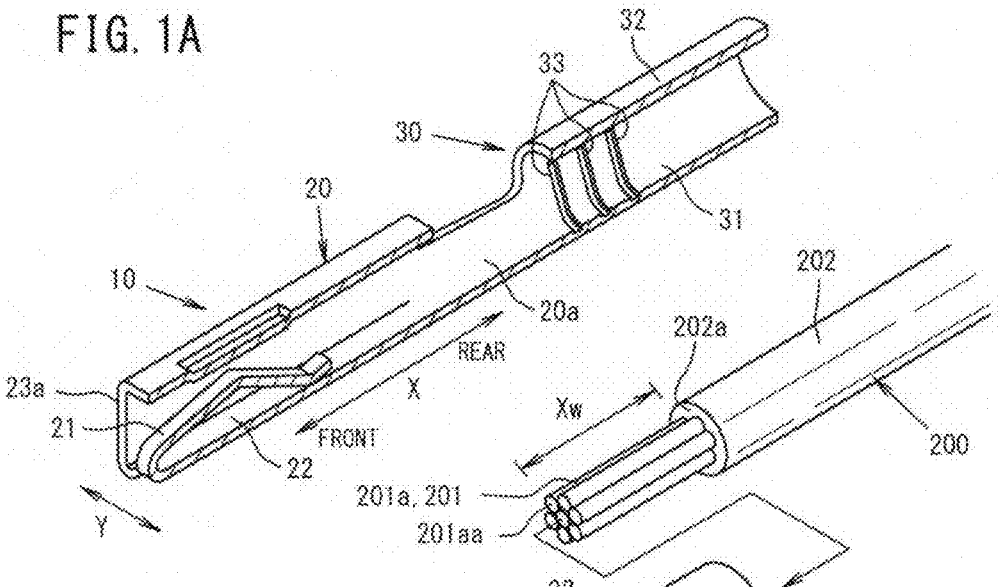
FIGS. 1(*a*) to 1(*c*) shows a method for pressure-bonding a pressure-bonding section of a female crimp terminal to an insulated wire.
Figure 1B:
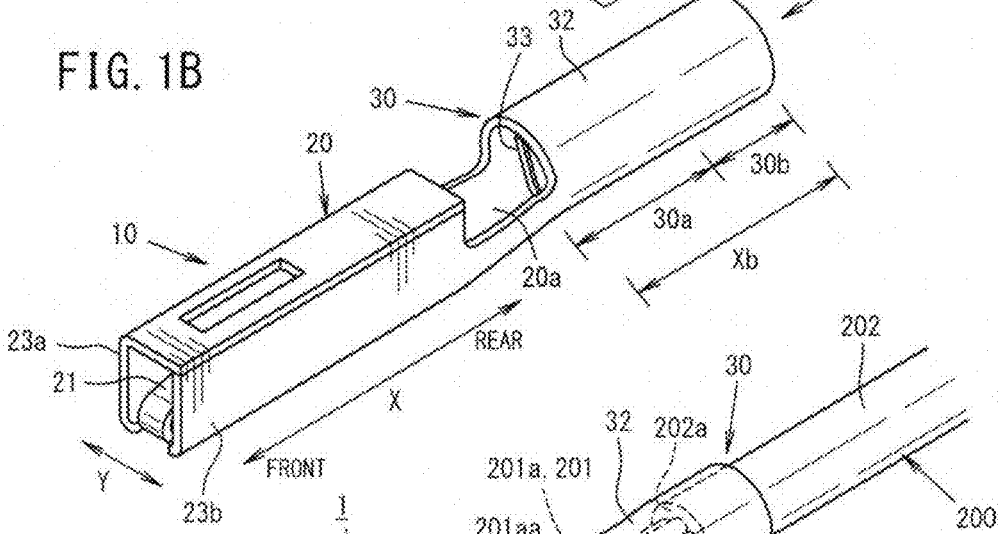
Figure 1C:
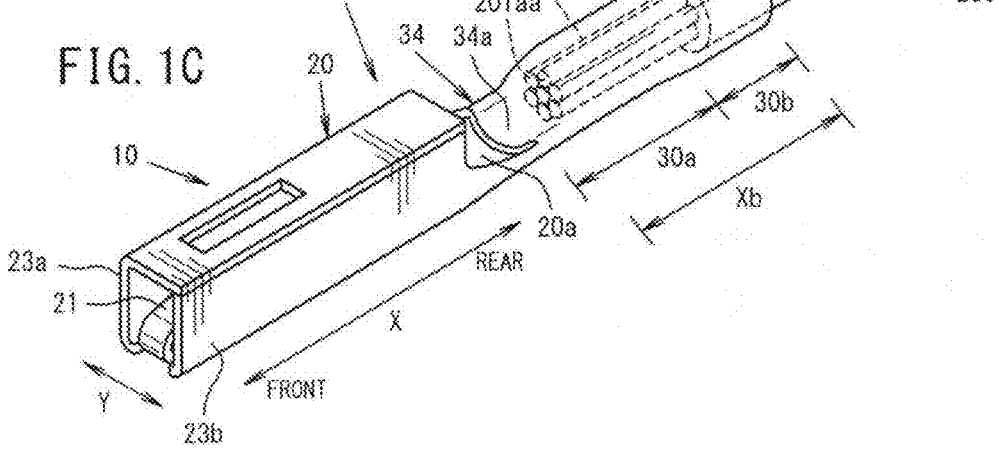

FIGS. 1(*a*) to 1(*c*) shows a method for pressure-bonding a pressure-bonding section 30 of a female crimp terminal 10 to an insulated wire 200. In more detail, FIG. 1(*a*) is a cross-sectional view of the female crimp terminal 10 in a pre-pressure-bonding state taken along a plane extending in a longitudinal direction thereof along a center of a width direction thereof. FIG. 1(*b*) is an isometric view of the female crimp terminal 10 and the insulated wire 200 in the pre-pressure-bonding state. FIG. 1(*c*) is an isometric view of a pressure-bonding connection structural body 1.

Figure 2A:
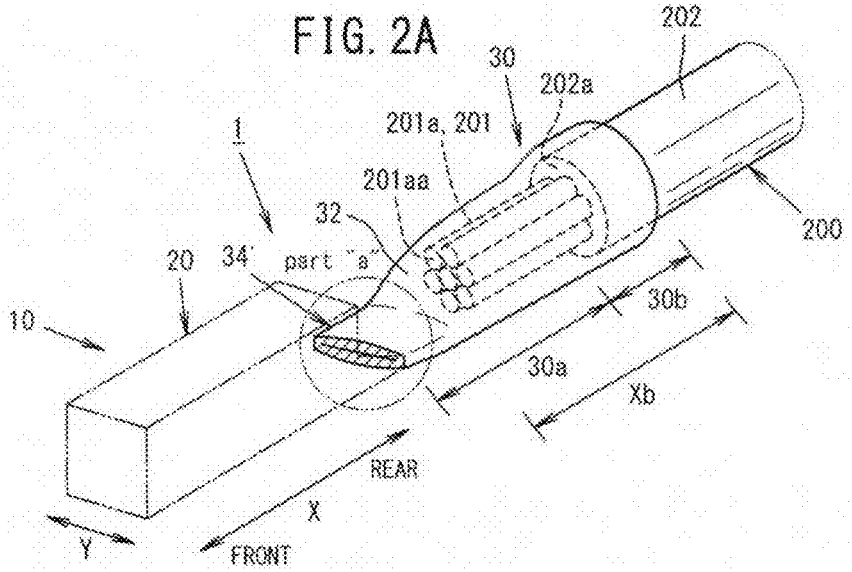
FIGS. 2(*a*) to 2(*c*) shows a method for forming a concaved sealing portion on a tip side of the pressure-bonding section.
Figure 2B:
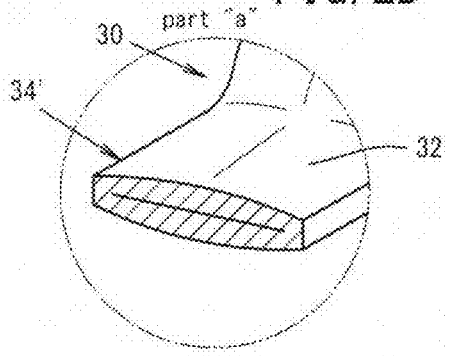
Figure 2C:
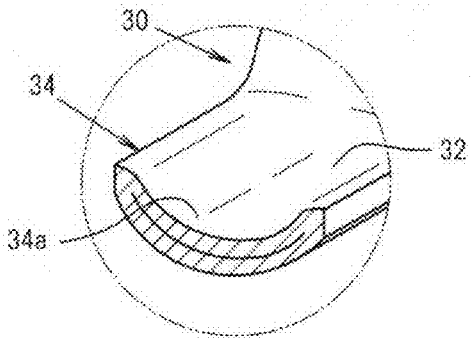
Figure 3:
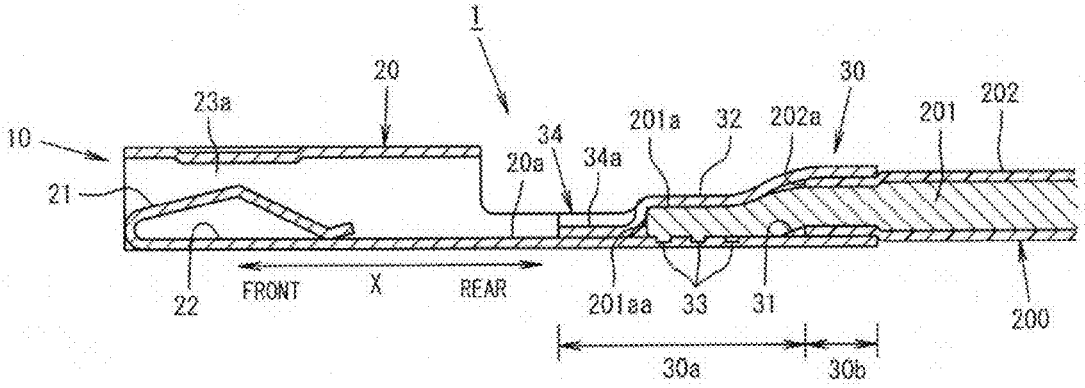
FIG. 3 is a cross-sectional view of the female crimp terminal in a post-pressure-bonding state taken along a plane extending in a longitudinal direction thereof along a center of a width direction thereof.

FIGS. 2(*a*) to 2(*c*) shows a method for forming a concaved sealing portion 34 on a tip side of the pressure-bonding section 30. In more detail, FIG. 2(*a*) is an isometric view of the female crimp terminal 10 in which the pressure-bonding section 30 includes a flat sealing portion 34' on the tip side thereof. The flat sealing portion 34' is formed as a result of pressure-bonding. FIG. 2(*b*) is an enlarged view of part "a" of FIG. 2(*a*) showing the flat sealing portion 34'. FIG. 2(*c*) is an enlarged view of the concaved sealing portion 34. FIG. 3 is a cross-sectional view of the female crimp terminal 10 in a post-pressure-bonding state taken along a plane extending in a longitudinal direction thereof along a center of a width direction thereof.

The pressure-bonding connection structural body 1 in this embodiment includes the female crimp terminal 10 and the insulated wire 200 connected to the female crimp terminal 10. More specifically, a conductor tip 201*a* of an aluminum core wire 201 that is exposed from an insulating tip 202*a* of an insulating cover 202 of the insulated wire 200 is connected by pressure-bonding to the pressure-bonding section 30 of the female crimp terminal 10. Thus, the pressure-bonding connection structural body 1 is formed.

The insulated wire 200 connected to the female crimp terminal 10 by pressure-bonding includes the aluminum core wire 201 which includes a bundle of aluminum raw wires, and the insulating cover 202 formed of an insulating resin. The aluminum core wire 201 is covered with the insulating cover 202. In more detail, the aluminum core wire 201 is formed by twisting aluminum alloy wires so as to have a cross-sectional area having an area size of 0.75 $mm^2$.

The female crimp terminal 10 includes a box section 20 that allows an insertion tab of a male connector (not shown) to be inserted thereinto, and the pressure-bonding section 30 located rear to the box section 20. The box section 20 is located on a tip side or a front side of the female crimp terminal 10 in a longitudinal direction X. The box section 20 and the pressure-bonding section 30 are formed integrally while having a transition section 20*a* having a predetermined length being provided therebetween.

The longitudinal direction X matches a longitudinal direction of the insulated wire 200 connected to the pressure-bonding section 20 as a result of pressure-bonding the pressure-bonding section 30.

The female crimp terminal 10 is formed of a copper alloy strip (not shown) such as a brass strip or the like having a tin-plated (Sn-plated) surface. The female crimp terminal 10 is a closed-barrel-shaped terminal including the box section 20 and the pressure-bonding section 30. The box section 20 is provided on the front side in the longitudinal direction X and has a hollow quadrangular prism shape. The pressure-bonding section 30 is provided on the rear side in the longitudinal direction X and has an annular cross-section.

A male crimp terminal (not shown) includes a pressure-bonding section having an insertion tab, which is inserted into a box section. Such a male crimp terminal has substantially the same structure (see FIGS. 1(*a*) to 1(*c*) and FIG. 3).

The box section 20 having the hollow quadrangular prism shape has an elastic contact piece 21 in a front part of an inner space thereof. The elastic contact piece 21 is folded rearward in the longitudinal direction X and contacts the insertion tab (not shown) of the male connector which is inserted into the box section 20.

The box section 20 includes a bottom portion 22 and side portions 23*a* and 23*b*. The side portions 23*a* and 23*b* are provided along, and continuous from, two sides of the bottom portion 22 in a Y direction perpendicular to the longitudinal direction X, and are folded up from the bottom portion 22. As seen from the front side in the longitudinal direction X, the box section 20 is generally rectangular.

In the pre-pressure-bonding state, the pressure-bonding section 30 includes a pressure-bonding bottom portion 31 and a barrel piece 32 provided along, and continuous from, two sides of the pressure-bonding bottom portion 31 in the Y direction perpendicular to the longitudinal direction X. As seen from the rear side in the longitudinal direction X, the pressure-bonding section 30 is generally annular (see FIGS. 1(*a*) and (*b*)). The pressure-bonding section 30 has an inner space that allows the conductor tip 201*a* of the aluminum core wire 201 to be inserted thereinto.

A length Xb (see FIGS. 1(*b*) and 1(*c*)), in the longitudinal direction X, of the pressure-bonding section 30 is longer than a length Xw, in the longitudinal direction X, of the conductor tip 201*a* exposed forward from the insulating tip 202*a*, which is a front tip of the insulating cover 202 in the longitudinal direction X.

The pressure-bonding section 30 includes a wire pressure-bonding section 30*a* that pressure-bonds the conductor tip 201*a* of the aluminum core wire 201, and a cover pressure-bonding section 30*b* that pressure-bonds the insulating cover 202. The wire pressure-bonding section 30*a* and the cover pressure-bonding section 30*b* are formed integrally. An inner circumferential area of the pressure-bonding section 30 has a circumferential length and a shape conformed to an outer diameter of the insulating cover 202.

An inner surface of the wire pressure-bonding section 30*a* has three serrations 33 at a predetermined distance therebetween in the longitudinal direction X. The serrations 33 are grooves extending in the width direction Y. The aluminum core wire 201 penetrates into the serrations 33 in the state of being pressure-bonded.

The serrations 33 are continuous from the pressure-bonding bottom portion 31 to the barrel pieces 32 in the width direction Y.

The pressure-bonding section 30 includes a concaved sealing portion 34, in which portions of an inner surface of the pressure-bonding section 30 are in close contact with each other. As seen from the front side in the longitudinal direction X, the concaved sealing portion 34 has a generally U-shaped cross-section which is wide in the width direction Y.

The concaved sealing portion 34 is formed as follows.

First, a portion on the tip side of the pressure-bonding section 30 that protrudes forward from a tip 201*aa* of the conductor tip 201*a* is deformed to be flat and wide in the width direction Y. As a result, the flat sealing portion 34' deformed to be flat as seen from the front side in the longitudinal direction X is formed.

This will be described in more detail. The portion on the tip side of the pressure-bonding section 30 that protrudes forward from the tip 201*aa* of the conductor tip 201*a* is deformed such that an inner surface of the pressure-bonding bottom portion 31 and an inner surface of the barrel piece 32 facing each other are put into close contact with each other. As a result, the flat sealing portion 34' is formed on the tip side of the pressure-bonding section 30 (see FIGS. 2(*a*) and (*b*)).

After thus being formed, the flat sealing portion 34' is subjected to laser welding performed in the width direction to improve the water-blocking performance. Preferably, the laser welding is performed by use of fiber laser.

After the flat sealing portion 34' is welded by laser, the flat sealing portion 34' is pressurized by use of a member such as a crimper jig or the like (not shown) to be deformed to have a generally U-shaped cross-section. As a result, the concaved sealing portion 34 having a generally U-shaped cross-section which is wide in the wide direction Y as seen in the front side in the longitudinal direction X is formed. The concaved sealing portion 34 has a concaved portion 34*a* at an inner center part thereof (see FIG. 2(*c*) and FIG. 3).

In this manner, the portion on the tip side of the pressure-bonding section 30 is deformed to be flat to form the flat sealing portion 34', and then the flat sealing portion 34' is deformed to have a generally U-shaped cross-section to form the concaved sealing portion 34. Thus, the pressure-bonding section 30 is assured to provide the water-blocking performance on the tip side.

The concaved sealing portion 34 having a generally U-shaped cross-section as a result of deformation is provided on the tip side of the pressure-bonding section 30. In this case, as compared with the case where a sealing portion which is merely flat and wide in the width direction Y is formed by pressure-bonding, the cross-sectional coefficient is higher and thus the female crimp terminal 10 is assured to have a sufficient strength.

Therefore, the concaved sealing portion 34 can prevent water from entering the pressure-bonding section 30 from the tip side thereof, and also is strong and thus is not bent in the middle.

Now, the pressure-bonding connection structural body 1 including the crimp terminal 10 and the insulated wire 200 connected to the female crimp terminal 10 will be described. In the pressure-bonding connection structural body 1, the aluminum core wire 201 of the insulated wire 200 is pressure-bonded to the pressure-bonding section 30 of the female crimp terminal 10 (see FIGS. 1(*a*) to 1(*c*) through FIG. 3).

This will be described in more detail. The insulated wire 200 is located in the pressure-bonding section 30 such that the tip 201*aa* of the conductor tip 201*a* of the aluminum core wire 201 that is exposed forward from the insulating cover 202 of the insulated wire 200 is located rear to the tip side of the pressure-bonding section 30 in the longitudinal direction X (front tip of the barrel piece 32).

Then, as shown in FIG. 1(*c*), the conductor tip 201*a* from the tip 201*aa* to a position rear to the insulating tip 202*a* of the insulating cover 202 is integrally pressure-bonded and enclosed by the pressure-bonding section 30.

After the insulated wire 200 is located in the pressure-bonding section 30, the entirety of the pressure-bonding section 30 is pressurized by use of, for example, a member such as a crimper jig or the like (not shown) to be deformed such that the diameter of the pressure-bonding section 30 is reduced and the pressure-bonding section 30 covers the insulating cover 202 of the insulated wire 200 and the conductor tip 201*a* of the aluminum core wire 201. Thus, the pressure-bonding section 30 and the aluminum core wire 201 are connected to each other by pressure-bonding.

In the pressure-bonding connection structural body 1 having such a structure, the pressure-bonding section 30 is completely sealed on the tip side by the concaved sealing portion 34 such that the aluminum core wire 201 of the insulated wire 200 is not exposed outside. Therefore, after the pressure-bonding, water is prevented from entering the inside of the pressure-bonding section 30 from the tip side thereof. Thus, galvanic corrosion, which would be caused by moisture attaching a contact part where the female crimp terminal 10 formed of copper or a copper alloy that is a nobler metal material and the aluminum core wire 201 formed of aluminum or an aluminum alloy that is a less noble metal material are connected each other, is prevented.

Therefore, corrosion of the surface of the aluminum core wire 201, which would reduce the conductivity between the female crimp terminal 10 and the aluminum core wire 201, is prevented, and thus the water-blocking state can be maintained for a long time. Thus, high reliability is provided.

Namely, since the insulated wire is pressure-bonded with a desirable shape as described above, the insulated wire can include a conductor more lightweight than a conductor formed of a copper-based material while being protected against corrosion.

As a result, the pressure-bonding connection structural body 1 assured to have stable conductivity in a connected state can be provided regardless of the types of metal used to form the crimp terminal 10 and the conductor of the insulated wire 200.

Figure 4:
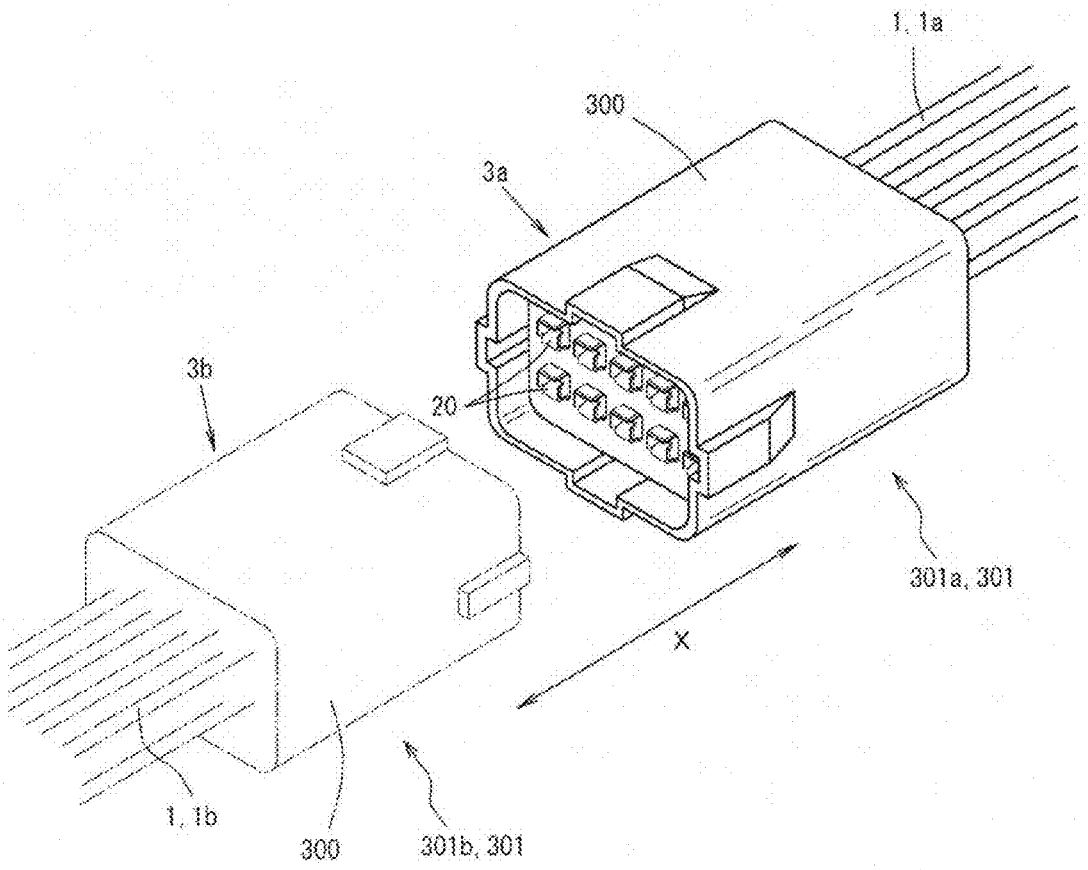
FIG. 4 shows connectors.
Figure 5A:
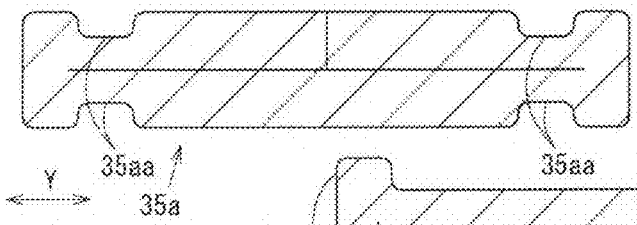
FIGS. 5(*a*) to 5(*h*) shows concaved sealing portions in other embodiments.
Figure 5B:
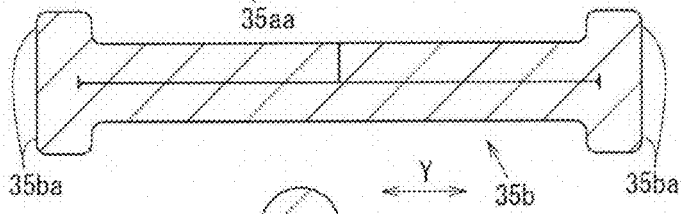
Figure 5C:
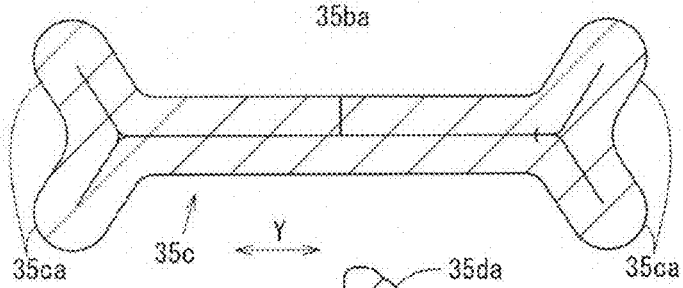
Figure 5D:
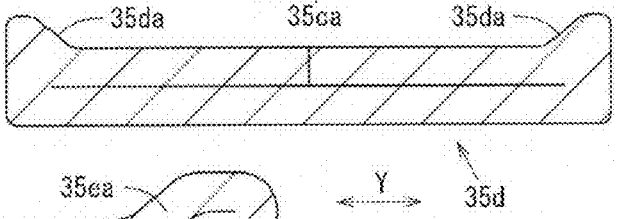
Figure 5E:
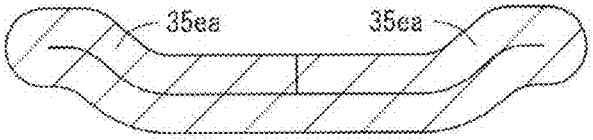
Figure 5F:
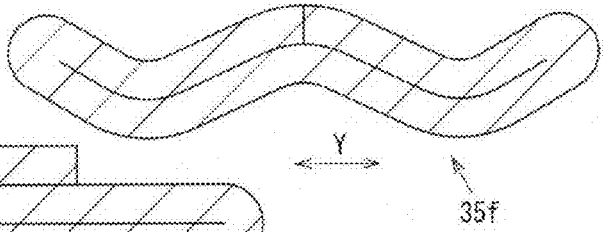
Figure 5G:
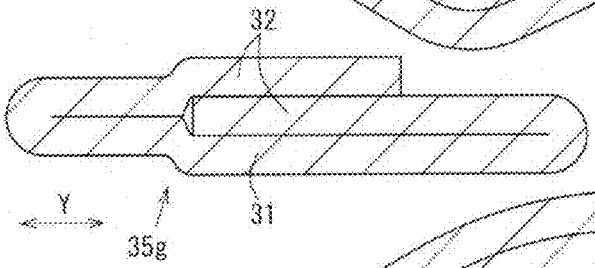
Figure 5H:
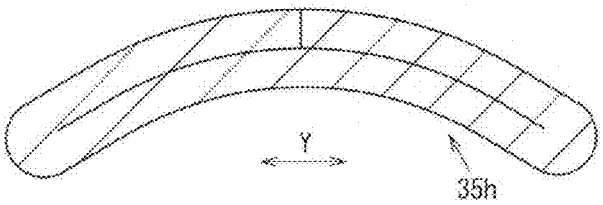

Now, with reference to FIG. 4, an example in which a pressure-bonding connection structural body 1*a* including the above-described female crimp terminal 10 and a pressure-bonding connection structural body 1*b* including a male crimp terminal (not shown) are respectively connected to a pair of connector housings 300 will be described.

The pressure-bonding connection structural body 1*a* is a connection structural body including the female crimp terminal 10, and the pressure-bonding connection structural body 1*b* is a connection structural body including the male crimp terminal.

By connecting the pressure-bonding connection structural bodies 1 (1*a*, 1*b*) to the connector housings 300 respectively, a female connector 3*a* and a male connector 3*b* having conductivity with certainty can be provided.

In the following example, both of the female connector 3*a* and the male connector 3*b* are connectors of wire harnesses 301 (301*a*, 301*b*). Alternatively, one of the female connector 3*a* and the male connector 3*b* may be a connector of a wire harness whereas the other of the female connector 3*a* and the male connector 3*b* may be a connector of an assisting element such as a substrate, a component or the like.

This will be described in more detail. As shown in FIG. 4, the pressure-bonding connection structural body 1*a* including the female crimp terminal 10 is attached to the female connector housing 300 to form the wire harness 301*a* including the female connector 3*a*.

The pressure-bonding connection structural body 1*b* including the male crimp terminal is attached to the male connector housing 300 to form the wire harness 301*b* including the male connector 3*b*.

By putting the female connector 3*a* and the male connector 3*b* each having the above-described structure into engagement with each other, the wire harness 301*a* and the wire harness 300*b* are connected to each other.

The connector housings 300 have the pressure-bonding connection structural bodies 1 attached thereto. Therefore, the wire harnesses 301 can be connected to each other while having conductivity with certainty.

Specifically, the female crimp terminal 10 of the pressure-bonding connection structural body 1*a* and the male crimp terminal of the pressure-bonding connection structural body 1*b* each have a sealing structure in which the conductor tip 201*a* of the aluminum core wire 201 of the insulated wire 200 is integrally covered with the pressure-bonding section 30 and is not exposed outside.

Therefore, even when the female crimp terminals are exposed to the air in the connector housing 300, galvanic corrosion, which would reduce the conductivity, is not caused. Thus, the electric connection between the aluminum core wire 201 located in the pressure-bonding section 30 and, for example, the crimp terminal 10 can be maintained. A connection state having conductivity with certainty is provided.

The conductor according to the present invention corresponds to the aluminum core wire 201 in the embodiment; and similarly, the connection structural body corresponds to the pressure-bonding connection structural body 1 or 1*a;* the crimp terminal corresponds to the female crimp terminal 10;

the sealing portion corresponds to the flat sealing portion 34' or the concaved sealing portion 34; and the connector corresponds to the female connector 3*a* or the male connector 3*b*.

However, the present invention is not limited to the above-described embodiment, and may be applied based on the technological idea of the claims and may be carried out in any of various forms.

For instance, in the above embodiment, the pressure-bonding section of the crimp terminal is connected by pressure-bonding to a wire conductor formed of a less noble metal material such as aluminum, an aluminum alloy or the like. Alternatively, the pressure-bonding section may be connected by pressure-bonding to a wire conductor formed of a nobler metal material such as copper, a copper alloy or the like. In this case also, substantially the same functions and effects as those of the above-described embodiment are provided.

This will be described in more detail. The pressure-bonding section 30 described above can prevent water from entering in the pressure-bonded state. Therefore, the pressure-bonding section 30 can be connected to an insulated wire including a core wire formed of, for example, copper, a copper alloy or the like, which conventionally needs to be sealed after being pressure-bonded in order to have an inter-wire water blocking function.

FIGS. 5(*a*) to 5(*h*) shows concaved sealing portions 35 in other embodiments. The cross-section of the concaved sealing portion does not need to be U-shaped as in the case of the concaved sealing portion 34 or generally elliptical, and may be, for example, generally semi-circular, generally V-shaped, generally W-shaped, generally U-shaped with angled corners, or of any of various other shapes as in the case of the concaved sealing portions 35 shown in FIGS. 5(*a*) to 5(*h*). Alternatively, such shapes may be inverted upside down.

This will be described more specifically. As shown in FIG. 5(*a*), the sealing portion may be a concaved sealing portion 35*a* having strongly pressure-bonded portions 35*aa*. The pressure-bonded portions 35*aa* are formed by strongly pressure-bonding, in an up-down direction, areas in the vicinity of both sides of the pressure-bonded portions 35*a* in the width direction Y. As shown in FIG. 5(*b*), the sealing portion may be a concaved sealing portion 35*b* having protrusions 35*ba* at both sides thereof in the width direction Y. The protrusions 35*ba* protrude upward and downward, so that the concaved sealing portion 35*b* is generally T-shaped on each side as seen in a plan view. As shown in FIG. 5(*c*), the sealing portion may be a concaved sealing portion 35*c* having protrusions 35*ca* at both sides thereof in the width direction Y. The protrusions 35*ca* protrude obliquely upward and obliquely downward, so that the concaved sealing portion 35*c* is generally Y-shaped on each side as seen in a plan view. As shown in FIG. 5(*d*), the sealing portion may be a concaved sealing portion 35*d* having protrusions 35*da* at both sides thereof in the width direction Y. The protrusions 35*da* protrude upward, so that the concaved sealing portion 35*d* is generally L-shaped on each side as seen in a plan view.

As shown in FIG. 5(*e*), the sealing portion may be a concaved sealing portion 35*e* having bent portions 35*ea*. The bent portions 35*ea* are formed by shifting, in the up-down direction, areas in the vicinity of both sides of the pressure-bonded portions 35*e* in the width direction Y. The bent portions 35*ea* are parallel to the rest of the concaved sealing portion 35*e*. As shown in FIG. 5(*f*), the sealing portion may be a concaved sealing portion 35*f* which is generally W-shaped.

As shown in FIG. 5(*g*), the sealing portion may be a concaved sealing portion 35*g* in which left and right portions of the barrel piece 32 overlap the pressure-bonding bottom portion 31. The overlapping portions may have any of various shapes as described above.

As shown in FIG. 5(*h*), the sealing portion may be a concaved sealing portion 35*h* obtained by inverting the concaved sealing portion 34 upside down. The concaved sealing portion 35*h* has an inverted U-shaped cross-section protruding upward. Similarly, the concaved sealing portions 35 (35*a* through 35*g*) may be inverted upside down.

Regardless of whether the concaved sealing portions (35*a* through 35*h*) are inverted upside down or not, substantially the same effects as those provided by the concaved sealing portion 34 are provided.

The female crimp terminal 10 does not need to have the box section 20, and may include only the pressure-bonding section 30 including the concaved sealing portion 34.

In the above-described description, the flat sealing portion 34' is subjected to laser welding performed in the width direction and then deformed to have a U-shaped cross-section to provide the concaved sealing portion 34. Alternatively, the flat sealing portion 34' may be deformed to have a U-shaped cross-section and then subjected to laser welding.

In the above-described description, the portion on the tip side of the pressure-bonding section 30 is deformed to be flat and wide in the width direction Y as seen in the front side in the longitudinal direction X to form the flat sealing portion 34', and then the flat sealing portion 34' is deformed to have a generally U-shaped cross-section to form the concaved sealing portion 34. Alternatively, the inner surface of the pressure-bonding bottom portion 31 and the inner surface of the barrel piece 32 may be put into close contact with each other while being deformed at the same time such that the pressure-bonded portion have a generally U-shaped cross-section to form the concaved sealing portion 34.

A part of, or the entirety of, the transition section 20*a* located rear to the box section 20 may be continued with the concaved sealing portion 34 so as to have a generally U-shaped cross-section. Alternatively, only the transition section 20*a* may be deformed to have a generally U-shaped cross-section.

Figures 6A, 6B, 6C:
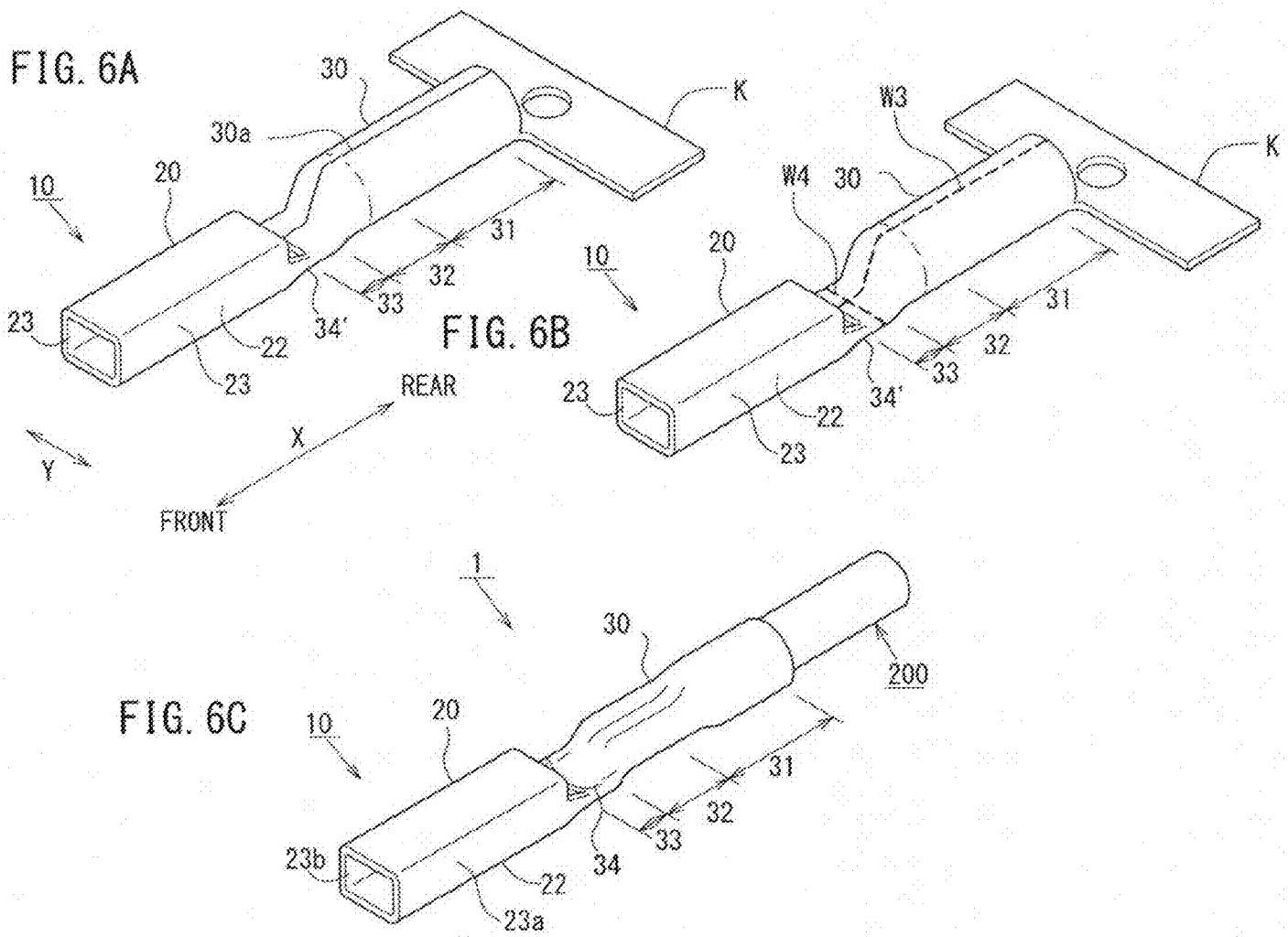
FIGS. 6(*a*) to 6(*c*) shows another welding method usable for the pressure-bonding section.

According to an embodiment, the pressure-bonding section 30 is formed as follows. A copper strip punched out to have the shape of the terminal is rolled such that ends of the rolled copper strip facing each other are joined together. The ends are welded along a welding line defined in the longitudinal direction X to be generally O-shaped as seen from the rear side. Then, a front tip portion thereof in the longitudinal direction X is deformed and welded for sealing along a welding line defined in the width direction Y. The pressure-bonding section 30 formed in this manner has a generally cylindrical shape, is sealed by the sealing portion at the front end in the longitudinal direction X, and is opened rearward in the longitudinal direction X. FIGS. 6(*a*) to 6(*c*) shows another welding method usable for the pressure-bonding section 30. As shown in FIGS. 6(*a*) to 6(*c*), the copper strip may be formed into the shape of the pressure-bonding section 30 and then welded along the welding line to form the pressure-bonding section 30.

This will be described in more detail. As shown in FIG. 6(*a*), a copper strip punched out to have the shape of the terminal is rolled, and the front portion in the longitudinal direction X is deformed, so that the shape of the pressure-bonding section 30 including the sealing portion is provided.

Then, ends facing each other of the copper strip thus shaped are joined together along a welding line W3 defined in the longitudinal direction X, and the sealed portion is welded along a line W4 defined in the width direction Y. Thus, the pressure-bonding section 30 is formed.

The ends facing each other may be welded on the bottom side of the pressure-bonding section 30. Alternatively, as shown in FIGS. 6(*a*) and (*b*), the ends facing each other may be welded on the top side of the pressure-bonding section 30.

Still alternatively, as shown in FIG. 6(*c*), in the pressure-bonded state, the cover pressure-bonding section 30*b* of the pressure-bonding section 30 may be pressure-bonded to the insulating cover 202 of the insulated wire 200 such that the cover pressure-bonding section 30*b* is annular as seen from the front side, and the wire pressure-bonding section 30*a* may be pressure-bonded to the aluminum core wire 201 such that the wire pressure-bonding section 30*a* is U-shaped as seen from the front side.

In the method shown in FIGS. 6(*a*) to 6(*c*), while the pressure-bonding section 30 is attached to a strip-like carrier K, the pressure-bonding section 30 is subjected to the welding. The pressure-bonding section 30 may be detached from the carrier K at the time when the insulated wire 200 is connected by pressure-bonding to the pressure-bonding section 30 or after the insulated wire 200 is connected thereto. Alternatively, the female crimp terminal 10 may be formed in the state of being separated from the carrier K, and the insulated wire 200 may be connected thereto by pressure-bonding.

REFERENCE SIGNS LIST

1, 1*a* . . . Pressure-bonding connection structural body
3*a* . . . Female connector
3*b* . . . Male connector
10 . . . Female crimp terminal
30 . . . Pressure-bonding section
31 . . . Pressure-bonding bottom portion
32 . . . Barrel piece
34, 35 . . . Concaved sealing portion
34*a* . . . Concaved portion
200 . . . Insulated wire
201 . . . Aluminum core wire
201*a* . . . Conductor tip
202 . . . Insulating cover
202*a* . . . Insulating tip
300 . . . Connector housing
X . . . Longitudinal direction
Y . . . Width direction

The invention claimed is:

1. A crimp terminal, comprising:

a connection section connectable with a connection section of another terminal; and a pressure-bonding section, adjacent to the connection section, that allows at least a conductor tip of a conductor of an insulated wire extending in a longitudinal direction to be connected thereto by pressure-bonding, the conductor being covered with an insulating cover, and the conductor tip being exposed as a result of removing the insulating cover, wherein:

the pressure-bonding section includes an annular cross-section and includes an inner space that allows at least the conductor tip to be inserted thereinto, a distal end of the pressure-bonding section adjacent to the connection section is deformed such that inner surfaces of the distal end are in close contact with each other to seal the pressure-bonding section at a sealing portion, and the distal end includes a concaved-shaped cross-section, the distal end is deformed such that a center area of the distal end in a width direction with respect to the longitudinal direction when the inner surfaces of the distal end are in close contact with each other is shifted to either upward or downward to form an arc shape when viewed from the longitudinal direction, so that the sealing portion is curved in the arc shape along the width direction, a welded portion that extends in the width direction is formed in the sealing portion along the arc shape, the distal end is provided between the conductor tip and the connection section, and a plurality of serrations are provided on an inner surface of the pressure-bonding section.

2. The crimp terminal according to claim 1, wherein the distal end is welded in the width direction such that the inner surfaces of the distal end are fixed to each other.

3. The crimp terminal according to claim 1, wherein the conductor is formed of an aluminum-based material, and at least the pressure-bonding section is formed of a copper-based material.

4. A connection structural body, comprising the insulated wire and the crimp terminal according to claim 1, which are connected to each other by the pressure-bonding section of the crimp terminal.

5. A wire harness, comprising a plurality of the connection structural body according to claim 4 bound together.

6. A connector, comprising the crimp terminal in the connection structural body according to claim 4, the crimp terminal being located in a connector housing.

7. The crimp terminal according to claim 1, wherein the distal end includes the concaved-shaped cross-section in an entirety of the longitudinal direction of the distal end.

8. The crimp terminal according to claim 1, wherein the connection section and the pressure-bonding section are formed integrally.

9. The crimp terminal according to claim 8, wherein a transition section is provided between the connection section and the pressure-bonding section.

10. The crimp terminal according to claim 1, wherein the plurality of serrations are grooves extending in the width direction.

11. The crimp terminal according to claim 1, wherein the plurality of serrations are provided on the inner surface of the pressure-bonding section at a predetermined distance therebetween in the longitudinal direction.

12. The crimp terminal according to claim 1, wherein a joined portion at which ends of the crimp terminal are welded and joined together is formed as a welded portion extending in the longitudinal direction to form the pressure-bonding section as tube-shaped with the annular cross-section, and in the sealing portion, the welded portion extending in the longitudinal direction and the welded portion that extends in the width direction cross each other.

13. A crimp terminal, comprising:

a connection section connectable with a connection section of another terminal; and a pressure-bonding section, adjacent to the connection section, that allows at least a conductor tip of a conductor of an insulated wire extending in a longitudinal direction to be connected thereto by pressure-bonding, the conductor being covered with an insulating cover, and the conductor tip being exposed as a result of removing the insulating cover, wherein:

a joined portion at which ends of the crimp terminal are welded and joined together is formed as a welded portion extending in the longitudinal direction to form the pressure-bonding section as tube-shaped with an annular cross-section, the pressure-bonding section includes an inner space that allows at least the conductor tip to be inserted thereinto, a distal end of the pressure-bonding section adjacent to the connection section is deformed such that inner surfaces of the distal end are in close contact with each other to seal the pressure-bonding section at a sealing portion, and the distal end includes a concaved-shaped cross-section, the distal end is deformed such that a center area of the distal end in a width direction with respect to the longitudinal direction when the inner surfaces of the distal end are in close contact with each other is shifted to either upward or downward to form an arc shape when viewed from the longitudinal direction, so that the sealing portion is curved in the arc shape, in a vertical plane, with respect to the welded portion extending in the longitudinal direction, the distal end is provided between the conductor tip and the connection section, and a plurality of serrations are provided on an inner surface of the pressure-bonding section.

* * * * *